United States Patent [19]

Hall et al.

[11] 4,417,922

[45] Nov. 29, 1983

[54] SINTERED HARD METALS

[76] Inventors: Fred W. Hall, Metallurg Group Industrial Development Office, 64 Fargate, Sheffield, South Yorkshire, S1 2HE, England; Hans-Joachim Retelsdorf, Gesellschaft für Elektrometallurgie m.b.H., Zentrale Forschung, Postfach 2844, 8500 Nüremberg 1, Fed. Rep. of Germany

[21] Appl. No.: 285,189

[22] PCT Filed: Nov. 10, 1980

[86] PCT No.: PCT/GB80/00195

§ 371 Date: Jul. 20, 1981

§ 102(e) Date: Jul. 20, 1981

[87] PCT Pub. No.: WO81/01422

PCT Pub. Date: May 28, 1981

[30] Foreign Application Priority Data

Nov. 20, 1979 [GB] United Kingdom ..... 7940140

[51] Int. Cl.[3] ..... C22C 29/00; C22C 1/10

[52] U.S. Cl. ..... 75/236; 419/14

[58] Field of Search ..... 75/236, 238, 241, 242, 75/203, 205, 213, 226

[56] References Cited

U.S. PATENT DOCUMENTS

| | | | |
|---|---|---|---|
| Re. 22,073 | 4/1942 | Schwarzkopf | 75/236 |
| Re. 22,166 | 8/1942 | Schwarzkopf | 75/236 |
| 3,455,682 | 7/1969 | Barbaras | 75/226 |
| 3,703,368 | 11/1972 | Rudy | 75/175.5 |
| 3,708,355 | 1/1973 | Rudy | 148/32 |
| 3,736,107 | 5/1973 | Hale | 428/131 |
| 3,779,745 | 12/1973 | Rudy | 75/176 |
| 3,779,746 | 12/1973 | Rudy | 75/176 |
| 3,999,954 | 12/1976 | Kolaska | 428/545 |
| 4,049,876 | 9/1977 | Yamamoto | 75/242 |
| 4,066,451 | 1/1978 | Rudy | 419/15 |
| 4,212,671 | 7/1980 | Ettmayer et al. | 75/238 |
| 4,265,662 | 5/1981 | Miyake et al. | 75/238 |
| 4,342,594 | 8/1982 | Ettmayer et al. | 75/238 |

FOREIGN PATENT DOCUMENTS

| | | |
|---|---|---|
| 708525 | 5/1954 | United Kingdom . |
| 1117108 | 6/1968 | United Kingdom . |
| 1332451 | 10/1973 | United Kingdom . |

*Primary Examiner*—Brooks H. Hunt
*Assistant Examiner*—Anne Brookes
*Attorney, Agent, or Firm*—Young & Thompson

[57] ABSTRACT

Mixed crystals of zirconium and hafnium carbides, possibly including the carbonitrides, are used in place of tantalum carbide in sintered hard metals. The new products contain one or more hard metals of Groups IV to VI of the Periodic Table of the Elements other than the mixed crystals, in particular, titanium and tungsten carbides, possibly with carbides of vanadium, niobium, molybdenum or chromium, and one or more iron group metals or alloys, preferably cobalt, is or are used as a binder. The sintered hard metals are made essentially by a 2-stage process, mixed crystal material comprising zirconium and hafnium carbides being formed in the first stage and being combined with the binder in the second stage, the one or more other hard metals of Groups IV to VI being incorporated in one or both stages. Any tendency to microporosity, shown particularly by products having a nitrogen content, is avoided by hot isostatic pressing.

17 Claims, No Drawings

SINTERED HARD METALS

DESCRIPTION

This invention relates to sintered hard metals, which are mixed carbides of metals selected from Groups IV to VI of the Periodic Table of Elements and possibly other metals, in conjunction with metals or alloys of the iron group. The extreme hardness and wear resistance of such products make them very suitable for use as tools or tool tips, for use in machine tools, and for dies and components generally, where wear-resistance is essential.

Modern sintered hard metals, such as are used for the machining of materials producing long chips, consist of tungsten carbide, WC, titanium carbide, TiC, tantalum carbide, TaC, or the mixed carbide of tantalum and niobium, (Ta,Nb)C, with cobalt as the customary iron group metal or alloy as a binder. For the machining of materials producing short chips, the classical cobalt-bound tungsten carbide hard metals, i.e. WC-Co, are used, often with small additions, e.g. about 0.5%–3%. of other carbides, such as TiC, TaC, NbC or VC.

Owing to the increasing cost of tungsten, replacements for tungsten carbide in hard metals have been investigated, leading to the development of hard metals free from or low in tungsten, such as those based on (Ti,Mo)C, Ti(C,N) or (Ti,Mo)(C,N) which developments still continue .

As a result of development in other directions, the WC content, constituting the hexagonal phase of hard metals, has been partially replaced by isomorphous phases, such as MoC, Mo(C,N) and (MoW)(C,N), while the cubic phase, usually containing TiC, TaC and/or NbC, has been partially replaced by HfC, VC and the corresponding mixed crystals. Depending on the production and sintering conditions employed, the cubic phase contains variable quantities of WC in solid solution.

Just as attempts have been made to replace tungsten carbide in hard metals, so has appeared the parallel necessity for a significant substitution of TaC, which is commonly a constituent of most sintered hard metals. The main reason for this need is that high Ta ores, in contrast to high Nb ores, are relatively scarce and, furthermore, Ta metal has latterly found greatly increasing use in the electronics industry. Developments brought about by the increasing scarcity and expensiveness of Ta, and hence of TaC also, have found that up to 50% of the TaC can be replaced by the lighter and cheaper NbC. (As is well known, Nb is 20 times as plentiful in the earth's crust as Ta). A total or partial replacement of TaC by HfC was also found possible and led to hard metals of outstanding properties.

However, at that time, the scarcity and resulting high prices of Hf and HfC precluded a broad introduction of this development. A certain break-through has come about recently, as a result of the growing zirconium industry, which has required an enforced separation of Hf and the consequent need to separate zirconium and hafnium from one another and from the ores which commonly contain them both. European and American research workers have established that niobium and hafnium carbide mixed crystals, (Nb,Hf)C, can not only replace TaC, but can even lead to hard metals of 20%–30% increased performance. (As in the remainder of this disclosure, all percentages are by weight, unless otherwise indicated, and all ratios are also by weight; in the case of the mixed crystal product just mentioned, (Nb,Hf)C, the ratio is in the range from 4:6 to 7:3). In the absence of more important uses, the Hf production of the zirconium industry can be absorbed by the hard metal industry.

It can thus be seen that products comprising sintered hard metals where the conventional hexagonal tungsten carbide has been partly replaced by MoC, Mo(C,N) or (Mo,W)(C,N) and where the conventional TaC or (Ta,Nb)C has been partly replaced by mixed hafnium/-niobium carbides, could be expected to perform satisfactorily, whilst having the distinct advantages of being lighter and less expensive. However, the substitution of TaC by ZrC in WC-TiC-TaC hard metals has not been investigated, nor is there any such mention in the literature. The substitution of TiC by ZrC has been investigated and led to the discouraging result that it is necessary to employ 1.7 to 2.0 parts of ZrC in order to replace 1 part of TiC.

In an attempt to find improved sintered hard metals which avoid the use of tantalum carbide, at least to a certain extent, without involving unacceptable disadvantages, the prior attempts, as reported in the literature from about 1950, were first reviewed and also a survey was carried out of the behaviour of the mixed crystals of ZrC with TiC, HfC, VC, NbC, TaC, MoC and $Cr_3C_2$ respectively. This has resulted in the surprising discovery that mixed crystals of ZrC and HfC resemble TaC in hard metal technology and even give increased resistance to crater formation. It has also been established that this new and advantageous effect extends over a range of ZrC:HfC of at least 7:1 to 1:7, though even higher ZrC proportions are possible as indicated below. The TaC substitution effect and improved resistance to crater formation are already strongly marked at the economic proportions of 4:1 to 3:1, reaching an optimum at the currently less economic proportions of 2:1 to 4:6.

According to one aspect of this invention, therefore, a sintered hard metal contains zirconium and hafnium carbines in mixed crystal form, together with one or more carbides of metals of Groups IV to VI and a binder comprising one or more metals or alloys of the iron group.

According to a preferred feature of the sintered hard metals of the invention, the mixed crystal material of or comprising ZrC and HfC is present in an amount in the range from 1% to 30% and, most preferably, from 2% to 20%. As indicated previously, these ranges are in percentages by weight.

It has further been established that the relative proportions of ZrC and HfC in the mixed crystal material incorporated into the products of the invention can vary over very wide limits, though it is preferable for economic reasons for the ZrC to predominate. In accordance with another preferred feature of the invention, the mixed crystal material comprises ZrC and HfC in proportions by weight in the range from 9:1 to 1:7. Stated in percentage terms, the proportion of ZrC in the ZrC/HfC material present can be as high as 90% or as low as 12.5%. The proportion more preferably lies in the range from 90:10 to 50:50, i.e. from 9:1 to 1:1 or, in percentage terms, from 87.5% to 50%; most preferably, the range of proportions of ZrC to HfC is from 60:40 to 80:20, i.e. the ZrC comprises from 60% to 80% of the total ZrC/HfC content of the sintered hard metal product .

It has further surprisingly been found that ZrC-HfC-TiC mixed crystal materials produced by high temperature sintering, e.g. treatment for 2 hours at about 2200° C. and final eutectic sintering with Co at about 1500° C., decompose spinodally on cooling into two isomorphous mixed crystals. As will appear in more detail below, this is a typical operation, in accordance with the process of this invention, for preparing the sintered hard metals of the invention. The pure pseudobinary ZrC-HfC mixed crystals do not show the miscibility gap and decomposition which take place in the systems comprising TiC-ZrC and TiC-HfC. In the finished hard metal of the invention, the decomposition of the TiC-ZrC-HfC mixed crystals produces a very fine grain size with increased hardness and a reduced tendency to cratering.

In recent years, carbonitrides, especially those based on Ti(C,N) and (Ti,Mo)(C,N), have attained appreciable technical importance. In the development of the present invention, an investigation has been made into the substitution of a small part of the carbon in the ZrC-HfC mixed crystal by nitrogen. It has been discovered that this can be achieved, so that according to another preferred feature of the invention, the mixed crystal material comprises zirconium and hafnium carbides or carbonitrides. One way in which this can be achieved is by the addition of nitrogen or a substance which is a source of nitrogen under the conditions employed, during the mixed crystal formation. This results in an equimolecular amount of carbon being displaced, which must be accommodated by use of an understoichiometric WC composition. In carrying out this embodiment of the invention, therefore, it is preferable to substitute C with N in the mixed crystals, e.g. by the use of nitrogen or a nitrogen source as indicated above, in such a way and to such an extent that the nitrogen comprises 5% to 20% by weight of the total combined carbon and nitrogen content of the mixed crystals, in the resultant sintered hard metal product.

It is known that substitution of the hexagonal phase, i.e. WC, normally present in hard metals, is possible, for instance, by (W,Mo)(C,N). It is known that hard metals containing nitrogen are prone to a certain microporosity, but it has also been established that any of the hard metal products of the invention can be treated so as to offset this, by subjecting the product to hot isostatic pressing or "hipping". By way of example, the conditions for this treatment can comprise heating at 1380°±25° C. under an argon pressure of 300–400 bar. No appreciable difference in mechanical and physical properties can be found between the nitrogen-containing and nitrogen-free grades but, nevertheless, the nitrogen-containing grades give improved machining performance.

It will also be evident to those skilled in the art that products made from the hard metals of the invention, e.g. throw-away tips, dies or other wear-resistant components, can be coated from the gas phase with a wear-resistant material (e.g. with TiC, TiN, Ti(C,N), HfN or $Al_2O_3$), in order to give better machining performance.

The invention additionally provides a process of manufacture of a sintered hard metal, which comprises heating a mixture comprising zirconium and hafnium carbides or zirconium carbide, hafnium carbide and at least one other carbide of a metal of Groups IV to VI of the Periodic Table of the Elements under such conditions as to produce a product containing mixed crystals of zirconium and hafnium carbides and then heating the product, in comminuted form, or the product in comminuted form and at least one other carbide of a metal of Groups IV to VI of the Periodic Table, in conjunction with one or more metals of the iron group under such conditions as to produce the final product desired.

The invention also consists in a process of manufacture of a sintered hard metal, which comprises heating a first mixture comprising zirconium and hafnium carbides under such conditions that the resultant first product contains zirconium and hafnium carbides in mixed crystal form, forming a second mixture from the first product in comminuted form and one or more metals or alloys of the iron group and heating the second mixture under such conditions that the resultant second product comprises a sintered hard metal acontaining the one or more metals or alloys of the iron group, zirconium and hafnium carbides in mixed crystal form and at least one other hard metal material, the latter being incorporated into either or both of the first and second mixtures.

In order that the invention may be readily understood, the following examples are given by way of illustration.

The following is a description of the production of a TaC-free hard metal according to the invention. The attempted alloy was 73% WC, 8.5% TiC, 7% ZrC, 3% HfC and 8.5% Co, the purpose being to produce a material to replace the American alloy type C5 or the European alloy type P25 of the typical composition 73% WC, 8.5% TiC, 10.5% TaC and 8.5% Co.

(a) 7 parts of ZrC were finely mixed with 3 parts HfC, pressed and heated at 2100°±100° C. under inert atmosphere. The resulting cubic mixed crystals, established by X-ray investigation as being homogeneous, were finely comminuted. The resulting fine powder (5μ) was mixed with WC (2–3μ), the necessary quantity of TiC (in the form of TiC-WC mixed crystal 2:1 (3–8μ)) and 8.5% Co and milled in an attritor under alcohol. The dried mixture was pressed into compacts and sintered under vacuum at 1450°±10° C. The physical and mechanical properties correspond to those of the comparison alloy containing TaC. In a short-term machining test, resistance to crater formation was distinctly better and built-up edge effect was insignificantly better.

(b) In order to make full use of the miscibility gap in the systems ZrC-TiC and HfC-TiC, the following alternative route was taken. 7 parts ZrC, 3 parts HfC and 8.5 parts TiC were wet-milled, dried, pressed and heated to 2200°±100° C. for 3 hours. The resulting mixed crystals, homogeneous under X-ray investigation, were crushed, finely-comminuted and mixed with the requisite amounts of WC and Co. Wet-milling, drying, pressing and sintering were carried out as under (a). The resulting hard metal, identical in analysis, was distinctly more fine-grained than that resulting from (a), (0.6–0.8μ instead of 1–1.2μ), and also it was 0.24–0.50 points harder in Rockwell. It was found that the cubic phase had decomposed into two isomorphous cubic phases, one ZrC rich containing some HfC, TiC and WC and the other TiC rich containing some ZrC, HfC and WC.

(c) The following describes the production and properties of an alloy according to the invention equivalent to the type PO5 or C7 of typical composition 70.5% WC, 12.5% TiC, 12% TaC, 5% Co. The alloy produced had the composition 71% WC, 13% TiC, 7% ZrC, 4% HfC and 5% Co. Its production method was similar to that described under (b).

In order to reduce the temperature of formation of the mixed crystals and to adjust the phase composition of the finished hard metal, 7 parts ZrC, 4 parts HfC and 20 parts WC-TiC mixed crystals (7:3), with the addition of 0.5% Co, were milled, pressed and heated for 2 hours at 1700°±50° C. The product was finely comminuted and found by X-ray analysis to be a homogeneous mixed crystal structure.

This mixed crystal product was wet-milled together with 64 parts WC and 4.5 parts Co. The resulting mixture was dried, pressed and sintered under vacuum at 1425°±25° C. The resulting spinodal decomposition of the cubic mixed crystal was only just discernible under the microscope, but its effect was clearly visible, the extremely fine grain size giving a smaller built-up edge and less cratering.

By the use of HfC-rich ZrC-HfC mixed crystals, larger quantities of TaC (15–25%) may be substituted in WC-TaC and WC-TiC-TaC special hard metals, although a partial exchange only may be indicated by economic grounds. As an example, a hard metal specification comprising 71% WC, 5% TiC, 8% TaC, 5% ZrC, 4% HfC and 7% Co has proved particularly suitable for the machining of superalloys.

Small quantities of TaC or TaC-VC are often added as grain growth inhibitors to WC-Co alloys used in the machining of materials giving short chips. ZrC-HfC mixed crystals can also be used for this purpose, although the pseudoternary mixed crystals of 1 part ZrC, 1 part HfC and 2 parts VC have proved still better. An example of such a development is a grade with 85% WC, 0.5% ZrC, 0.5% HfC, 1% VC and 13% Co.

We claim:

1. A sintered hard metal which comprises at least one carbide of a metal selected from the groups IV to VI of the Periodic Table of the Elements, a binder comprising one or more metals or alloys of the iron group and a mixed crystal material prepared by subjecting a mixture comprising titanium, zirconium and hafnium carbides to heating at a temperature and for a time sufficient for the mixed crystal product to undergo spinodal decomposition upon cooling, the amount of mixed crystal material present in the hard metal being in the range from 1% to 30% by weight of the hard metal.

2. A sintered hard metal according to claim 1, wherein the mixed crystal material is present in an amount in the range from 2% to 20% by weight of the hard metal.

3. A sintered hard metal according to claim 1, wherein the mixed crystal material is obtained by alloying zirconium and hafnium carbide mixed crystal with titanium carbide, the amount of titanium carbide present in the resultant mixed crystal material being in the range from 20% to 60% by weight of the mixed crystal material.

4. A sintered hard metal according to claim 1, wherein the mixed crystal material is derived from zirconium carbide and hafnium carbide provided in proportions by weight in the range from 9:1 to 1:7.

5. A sintered hard metal according to claim 4, wherein the mixed crystal material is derived from zirconium carbide and hafnium carbide provided in proportions by weight in the range from 60:40 to 80:20.

6. A sintered hard metal according to claim 1, wherein the mixture comprising titanium, zirconium and hafnium carbides is prepared by heating at 2100°–2300° C.

7. A sintered hard metal according to claim 1, which by weight contains about 73% tungsten carbide, 8.5% titanium carbide, 7% zirconium carbide, 3% hafnium carbide and 8.5% cobalt.

8. A sintered hard metal according to claim 1, which by weight contains about 71% tungsten carbide, 13% titanium carbide, 7% zirconium carbide, 4% hafnium carbide and 5% cobalt.

9. A sintered hard metal according to claim 1, which by weight contains about 78% tungsten carbide, 6% titanium carbide, 7% zirconium carbide, 4% hafnium carbide and 5% cobalt.

10. A sintered hard metal according to claim 1, which by weight contains about 71% tungsten carbide, 5% titanium carbide and 5% zirconium carbide.

11. A sintered hard metal according to claim 1, which contains at least one other hard material isomorphous with hexagonal tungsten carbide in an amount up to the amount of hexagonal tungsten carbide.

12. A sintered hard metal according to claim 11, wherein the hard material isomorphous with tungsten carbide is selected from the carbides and carbonitrides of molybdenum.

13. A process of manufacture of a sintered hard metal, in which a first mixture comprising titanium zirconium and hafnium carbides is heated under such conditions that the resultant first product contains titanium zirconium and hafnium carbides in mixed crystal form, a second mixture is formed from the first product in comminuted form and from at least one metal or alloy of the iron group, heating the second mixture under such conditions that the resultant second product comprises a sintered hard metal containing said at least one metal or alloy of the iron group and titanium, zirconium and hafnium carbides in spinodally-decomposed mixed crystal form and at least one other hard metal material, the latter being incorporated with titanium carbide into at least one of said first and second mixtures.

14. A process according to claim 13, wherein said first product consists essentially of zirconium, hafnium and titanium carbide spinodally-decomposed mixed crystal material and the second mixture is formed by mixing said first product with tungsten carbide and cobalt, all the carbides being in comminuted form.

15. A process according to claim 13, wherein said first product consists essentially of zirconium, hafnium, tungsten and titanium carbide spinodally-decomposed mixed crystal material, together with cobalt, and said second mixture is formed by mixing said first product with at least one of further tungsten carbide and further cobalt.

16. A process of manufacture of a sintered hard metal, comprising heating a mixture comprising titanium, zirconium and hafnium carbides under such conditions as to produce a spinodally-decomposed mixed crystal product containing titanium, zirconium and hafnium carbides, and then heating the product in comminuted form in the presence of at least one metal of the iron group, under such conditions as to produce the final product desired.

17. A process according to claim 16 wherein the mixture comprising titanium, zirconium and hafnium carbides is prepared by heating at 2100°–2300° C.

* * * * *